US010161694B2

(12) United States Patent
Maitrot et al.

(10) Patent No.: US 10,161,694 B2
(45) Date of Patent: Dec. 25, 2018

(54) METHOD FOR GUIDING A DEVICE FOR THE HIGH-PRESSURE CLEANING OF HEAT EXCHANGER TUBES

(71) Applicant: VEOLIA ENVIRONNEMENT VE, Paris (FR)

(72) Inventors: Aude Maitrot, Nanterre (FR); Alexandre Dubourg, Houilles (FR)

(73) Assignee: VEOLIA ENVIRONNEMENT VE, Paris (FR)

( * ) Notice: Subject to any disclaimer, the term of this patent is extended or adjusted under 35 U.S.C. 154(b) by 0 days.

(21) Appl. No.: 15/847,686

(22) Filed: Dec. 19, 2017

(65) Prior Publication Data

US 2018/0172372 A1 Jun. 21, 2018

(30) Foreign Application Priority Data

Dec. 19, 2016 (FR) ..... 16 62766

(51) Int. Cl.

| | |
|---|---|
| ***F28D 7/02*** | (2006.01) |
| ***F28G 1/16*** | (2006.01) |
| ***F28G 15/02*** | (2006.01) |
| ***F28G 15/04*** | (2006.01) |
| ***F28G 15/08*** | (2006.01) |
| ***F28G 15/00*** | (2006.01) |

(52) U.S. Cl.

CPC ..... *F28G 1/163* (2013.01); *F28G 1/16* (2013.01); *F28G 15/003* (2013.01); *F28G 15/02* (2013.01); *F28G 15/04* (2013.01); *F28G 15/08* (2013.01)

(58) Field of Classification Search

CPC . F28G 1/163; F28G 1/16; F28G 15/03; F28G 15/02; F28G 15/04; F28G 15/08; B05B 3/0418; B05B 1/341; B25C 7/0023; B25C 3/12; F16L 27/023; B08B 9/0433; B08B 9/0325

USPC ..... 165/95

See application file for complete search history.

(56) References Cited

U.S. PATENT DOCUMENTS

| | | | | |
|---|---|---|---|---|
| 4,691,723 | A | 9/1987 | Balzer et al. | |
| 5,442,826 | A * | 8/1995 | Murata | B08B 9/0325 15/104.062 |
| 6,418,947 | B1 * | 7/2002 | MacNeil | B08B 9/0433 134/166 C |
| 6,681,839 | B1 | 1/2004 | Balzer | |
| 2011/0247786 | A1 * | 10/2011 | Dixon | F28D 7/16 165/96 |
| 2013/0042894 | A1 | 2/2013 | Gromes | |
| 2015/0217305 | A1 * | 8/2015 | Yie | B24C 3/12 239/240 |
| 2015/0258694 | A1 | 9/2015 | Hand et al. | |

FOREIGN PATENT DOCUMENTS

| | | |
|---|---|---|
| EP | 0162309 A2 | 11/1985 |

OTHER PUBLICATIONS

Nov. 13, 2017 Search Report issued in French Patent Application No. 1662766 (in French).

* cited by examiner

*Primary Examiner* — Davis D Hwu
(74) *Attorney, Agent, or Firm* — Kenealy Vaidya LLP

(57) ABSTRACT

Some embodiments are directed to a method for guiding a high-pressure cleaning device for cleaning the inside of heat exchanger tubes, wherein the human eye has been replaced by an acquisition device, enabling to obtain images, making the automatic detection of tubes to be cleaned possible, with the possibility of remote visualization.

20 Claims, 6 Drawing Sheets

METHOD FOR GUIDING A DEVICE FOR THE HIGH-PRESSURE CLEANING OF HEAT EXCHANGER TUBES

CROSS REFERENCE TO RELATED APPLICATION(S)

This application claims the priority benefit under 35 U.S.C. § 119 of French Patent Application No. 1662766, filed on Dec. 19, 2016, the content of which is hereby incorporated in its entirety by reference.

BACKGROUND

Some embodiments generally relate to the guiding of a high-pressure cleaning device, in view of cleaning the inside of heat exchanger tubes.

The high-pressure cleaning of the tubes of a heat exchanger is a periodic operation that it typically carried out as part of the maintenance of this type of installation. Currently, this is a mainly manual or semi-manual operation, an operator remotely operates, using a remote control, one or several rods assembled on a mobile gantry (called a bundle cleaner).

Yet, the high-pressure cleaning of the tubes of a heat exchanger is, according to operators who usually carry out this task, a task that is not only tiring (mainly because of the standing position of the operator and the impact of external conditions), but also tedious (repetitiveness, over a large number of tubes) and potentially harmful regarding the safety of the operator.

Indeed, to be able to visualize the result of the actions of positioning the bundle cleaner that they carry out, the operator positions themselves very close to the exchanger (in particular, at a distance of between 1 m and 5 m away), which exposes them to potentially contaminated water mist coming from the exchangers (contaminated with hydrocarbons).

Finally, operators handling via a rod (or triangle) or more generally, a bundle cleaner (not connected to the exchanger to be cleaned), with very high-pressure water jets, it can occur that the exchanger, during cleaning, moves because of the pressure of the jets, in particular, when a tube is clogged, even that the exchanger or bundle cleaner suddenly recoils (by a piston effect) or that the rod breaks. This adds an additional risk for the safety of the operator.

Moreover, it is probable that the tiredness connected to this type of task can also lead to potential errors and a progressive slowing-down of the task.

Moreover, the positioning of the cleaning devices is, currently, today carried out with the naked eye, which is only possible in times of cleaning, during which the operator remains capable of seeing the result of their actions of positioning the bundle cleaner, in other words, by positioning themselves at a distance from the exchanger of less than 5 m. This is not possible when there are a lot of projections, or when the weather conditions are not good, or when the operator is too far away (bad weather, in particular).

SUMMARY

Thus, even if the cleaning operation is carried out on exchangers prepared beforehand, it is not optimal or beneficial that the positioning of the devices for cleaning heat exchanger tubes is only based on a visualization with the human eye. This makes detecting tube orifices and the relative position of the rails in relation to these orifices both too slow and too random, to achieve a robustness and an availability of the measurement in a broad spectrum of configurations.

To this end, the applicant has developed a method for guiding a high-pressure cleaning device, in view of cleaning the inside of the tubes of a heat exchanger, wherein the human eye has been replaced with an acquisition device, enabling to obtain images making it possible to automatically detect the tubes to be cleaned, with the possibility of remote visualization.

A related art device exists for cleaning heat exchanger tubes implementing a camera. Thus, U.S. Pat. No. 6,681,839 defines a cleaning device including a hose which is connected to a mechanism for positioning the hose equipped with a camera positioned on the heat exchanger. Such a device has the disadvantage of being connected to the exchanger, which may require resorting to flexible rails. In addition, such a device enables images to be acquired from the zone of positioning the rails only in the visible spectrum: this system is therefore very dependent on external conditions (in terms of lighting, projections, etc.).

In order to address or remedy this, the applicant has therefore developed a guiding method, wherein the camera and the lighting thereof are arranged independently of the exchanger, close to the cleaning device and not on the support plate of the exchanger, to align and correct the cleaning device with the exchanger tubes to be cleaned during a relative movement of one against the other.

More specifically, some embodiments are configured for guiding a high-pressure cleaning device, in view of cleaning the inside of the tubes of a heat exchanger with tube bundles that are substantially rectilinear, and which is not connected to the cleaning device (for example, U-shaped tubes), wherein:

- the tubes are substantially embedded in a support plate to the tubes, at the level of their inlet and outlet orifices, and
- the cleaning device (for example, a bundle cleaner) includes at least one rigid cleaning rod, and preferably or possibly between one and three rods, of which one of the ends is guided forward by a support and is intended to be inserted inside the tubes to clean them, the rod being arranged, substantially horizontally, on a mobile cart horizontally forward along a first axis, parallel to the symmetry axis of the rod, and along a second axis, perpendicular to the symmetry axis of the rod, and also moving forward vertically along a third axis, perpendicular to the symmetry axis of the rod;
- a direct and three-dimensional orthogonal reference marker ($x_0$, $y_0$, $z_0$) being connected to the support plate, such that the axes $x_0$ and $y_0$ thereof are contained in a vertical plane, substantially parallel to the plate and the axis $z_0$ thereof, is substantially horizontal (and therefore substantially parallel to the symmetry axis of the cleaned tubes);
- a direct and three-dimensional orthogonal comparison marker ($x_1$, $y_1$, $z_1$) being connected to the cart (3), such that the axis $z_1$ thereof is parallel to the symmetry axis of the rod (11), the position of the cart during a movement forward towards the support plate (22) being defined by the slope $z_1$ in relation to an initial position of the cart before movement defined by the slope $z_1=0$.

By high-pressure cleaning device, this means, in the sense of the present embodiments, a device able to send liquid cleaning jets (in particular aqueous), at a high or very high pressure (pressure, in particular, between 200 Bars to 3000 Bars, and more specifically, around 1000-1400 Bars). Typically, this is a bundle cleaner, such as illustrated in FIG. 1, which is conventionally used for the high-pressure cleaning of piping, and in particular, heat exchanger tubes.

The orthogonal reference ($x_0$, $y_0$, $z_0$) and comparison ($x_1$, $y_1$, $z_1$) markers, respectively connected to the support plate and to the cart, are virtual markers, which could each be materialized by a target object able to emit or reflect light, easy to detect in space, for example, by a camera.

Thus, according to some embodiments, the following can advantageously be used:

- a first target object including four luminous target points emitting (active target points) or being able to reflect light (passive target points), this first target object being arranged on the support plate, such that the four target points thereof constitute the orthogonal reference marker ($x_0$, $y_0$, $z_0$), and
- a second target object including four luminous target points emitting (active target points) or being able to reflect light (passive target points), this second target object being arranged on the mobile cart, such that the four target points thereof constitute the orthogonal comparison marker ($x_1$, $y_1$, $z_1$).

To carry out the method according to some embodiments, the following steps can or must be carried out:

A. taking a real image, by a camera, of the arrangement of inlet or outlet orifices at the level of the support plate, the camera being remote in relation to the center of the support plate;

B. sending the image to a first calculator which identifies the shape and the position of the orifices according to the marker ($x_0$, $y_0$, $z_0$) as well as their possible obstruction;

C. calibrating the comparison marker ($x_1$, $y_1$, $z_1$) in relation to the reference marker ($x_0$, $y_0$, $z_0$) to enable the obtaining in real time of the position of the hose in relation to the orifices;

D. from the real image, calculating, by a calculator, an optimal or enhanced path for positioning the rod to carry out the cleaning of all or most of the tubes, of which the orifices have the first visual marking, according to their arrangement in the marker ($x_0$, $y_0$ $z_0$), of the calibration between the reference ($x_0$, $y_0$ $z_0$) and comparison ($x_1$, $y_1$ $z_1$) markers and of the number of cleaning rods that the cleaning device includes, the optimal or enhanced path defining, by an order of succession, the movements $D_{ca}$ of the rod along the axes $x_1$ and $y_1$ between which at least two movements $D_{ch}$ of the cart along the axis $z_1$ take place to clean the tubes represented by their orifices including the first marking on the enhanced image;

E. displaying the optimal or enhanced path proposed and the enhanced image on a display screen;

F. carrying out, by an operator and/or a robot controlled by an algorithm, of a cleaning step $E_{net}$ including the sub-steps:

F1) movement $D_{ca}$ of the rod along the axes $x_1$ and $y_1$, such that the rod is arranged opposite a tube to be cleaned represented by the orifice thereof, including the first marking on the enhanced image°;

F2) a first movement $D_{ch}$ of the rod along the axis $z_1$, through the first orifice to clean the tube;

F3) once the tube is cleaned, a second movement $D_{ch}$ along the axis $z_1$ of the rod enabling the withdrawal outside of the orifice; then G. repeating steps D to F until all or most of the cleaning steps $E_{net}$ provided by the optimal or enhanced path are carried out.

The first step of the method according to some embodiments is step A of taking a real image of the inlet or outlet orifices at the level of the support plate. For this, preferably or possibly a high-resolution camera is used, for example, a monochrome digital 16-Megapixel (4096×4096) camera.

Advantageously, a near-infrared camera equipped with an optical filter can be used, with light emitting in the near-infrared.

The camera must or should be remote in relation to the center of the support plate, so as to be able to photograph the whole of the support plate, so as to obtain a complete image of the support plate without being obstructed by the cleaning device. However, it must or should be ensured, that the center of the camera is not too far away from the center of the plate, to avoid any image processing problems. Finally, it can also be useful for many reasons (water projections, assembly on cleaning head difficult, etc.) to move the camera laterally, such that it is not in a parallel plane to that of the plate. In this case, it must or should be necessarily ensured that the angle formed by the optical axis of the camera and the axis that is orthogonal to the support plate enables the camera to film the whole of the plate. Preferably or possibly, this angle can be between 30° and 45°.

The second step of the method according to some embodiments is step B, of sending the real image to a first calculator, which identifies the shape and the position of the orifices (according to the marker ($x_0$, $y_0$, $z_0$), as well as their possible obstruction. This sending can be done, for example, by wire or by radio waves.

Before a calculator proceeds with the calculation and with displaying the optimal or enhanced path (respectively steps F and G), it is important that the comparison marker ($x_1$, $y_1$, $z_1$) connected to the cart is calibrated (step E) in relation to the reference marker ($x_0$, $y_0$, $z_0$) connected to the support plate to enable the obtaining in real time of the position of the hose in relation to the orifices. The calibration phase consists of or includes coming to position the rods according to the four cardinal points in relation to the exchanger and to take a measurement at each position. By then entering the geometry of the different tubes, the system is self-calibrated and is capable of knowing the position that the comparison marker ($x_1$, $y_1$, $z_1$) must or should have vis-à-vis the reference marker ($x_0$, $y_0$, $z_0$). The geometry of the different tubes can come from information entered by the operator using simple tools, by using an image, for example, and/or the automatic detection of the tubes. It is therefore possible to project the current position of the rods onto the real or enhanced image.

From the real image, a calculator calculates (step D) an optimal or enhanced path for positioning the rod for cleaning the tubes, of which the orifices have the first visual marking, according to their arrangement in the marker ($x_0$, $y_0$ $z_0$), the calibration between the reference ($x_0$, $y_0$ $z_0$) and comparison ($x_1$, $y_1$ $z_1$) markers and the number of cleaning rods that the cleaning device includes. This optimal or enhanced path defines an order of succession of the movements $D_{ca}$ of the rod along the axes $x_1$ and $y_1$ of the comparison marker, between which at least two movements $D_{ch}$ of the cart along the axis $z_1$ (in other words, at least one two-way journey in relation to the departure point of the cart) take place to clean the tubes marked on the enhanced image.

This optimal or enhanced path, as well as the enhanced image with marked orifices, are displayed (step E) on a display screen.

During step F, the carrying out of a cleaning step $E_{net}$ can be done by an operator (entirely manual mode) and/or by a robot controlled by an algorithm (automatic or semi-automatic mode) as follows:

F1) the movements $D_{ca}$ of the rod along the axes $x_1$ and $y_1$, such that the rod is arranged opposite a tube to be cleaned, represented by the orifice thereof including the first marking on the enhanced image;

F2) a first movement $D_{ch}$ of the rod along the axis $z_1$, through the first orifice to clean the tube;

F3) once the tube is cleaned, a second movement $D_{ch}$ along the axis $z_1$ of the rod enabling the withdrawal outside of the orifice.

Steps D to F are repeated (steps G) until all or most cleaning steps $E_{net}$ provided by the optimal or enhanced path are carried out. These steps must or should not necessarily be carried out in the order provided by the optimal or enhanced path. If the cleaning step are not carried out in order, the second calculator recalculates the optimal or enhanced path at each step.

In the case of a manual cleaning method, it is possible to not follow the optimal or enhanced path. This is not possible if the cleaning is done by a robot controlled by an algorithm. These methods are explained below.

According to the manual embodiment, the operator controls all or most of the movements $D_{ca}$ and $D_{ch}$ of the rod during the cleaning step $E_{net}$, by following (or not) the order of succession of the movements $D_{ca}$ of the rod 11 defined by the optimal or enhanced path. In such an embodiment, all or most of the movements $D_{ca}$ of the rod provided by the optimal or enhanced path, are carried out by the operator, according to an order of succession which can be different to that which defines the optimal or enhanced path. In this case (order of succession different from the optimal or enhanced path), a calculator can actually indicate to the operator, the deviation in real time of the rod in relation to the optimal or enhanced path. Of course, the operator can choose to carry out all or most of the movements $D_{ca}$ of the rod according to the order of succession defined by the optimal or enhanced path.

In practice, in the manual mode, the operator positions the orthogonal comparison marker ($x_1$, $y_1$, $z_1$) in relation to the orthogonal reference marker ($x_0$, $y_0$, $z_0$), such that the hose (11) is arranged opposite an orifice to be cleaned that is chosen by the operator, by relying on the enhanced image and by considering (or not) the optimal or enhanced path proposed. A calculator (i.e. that which indicates to the operator the deviation in real time of the rod in relation to the optimal or enhanced path) continuously checks the alignment of the center of the orifice with the symmetry axis of the rod. While the alignment is not reached, this calculator sends back non-alignment information to the display screen, and the operator can continuously correct the positioning and the checking of the alignment.

According to the semi-automatic embodiment, the movements $D_{ca}$ of the rod along with axes $x_1$ and $y_1$ are carried out by a robot controlled by an algorithm, by following the order defined by the optimal or enhanced path, while an operator manually carries out the movements $D_{ch}$ of the rod along the axis $z_1$. In such an embodiment, the robot controlled by an algorithm must or should wait for the operator to carry out the movements $D_{ch}$ before starting the movements $D_{ca}$ of the following cleaning step $E_{net+1}$.

To facilitate the manual positioning of the hoses opposite the orifices, it is possible to consider a digital zoom in the image stream coming from the camera.

For manual and semi-automatic embodiments, the operator needs the optimal or enhanced path displayed on the display screen.

In this case, it can be advantageous that the real image is enhanced. In this case, it can be advantageous that the real image is corrected, so as to give a recovered image before being sent to the first calculator to generate an enhanced image. This correction can, for example, be carried out by image processing and by using markers positioned on the support plate. Such a correction has an interest when the image is taken with a strong perspective effect by a camera that is laterally remote in relation to the center of the exchanger.

Once the recovered image is received by the first calculator, the latter, generates from the real image (step B'), possibly recovered beforehand, an enhanced image including a first visual marking of the orifices of the tubes to be cleaned (marked orifices). This enhanced image is then sent to a second calculator (step B"), which then calculates, during step D, the optimal or enhanced positioning path form the real image. This sending can be done, for example, by wire or by radio waves.

Advantageously, the enhanced image generated in step B' can include, other than the first visual marking, a second visual marking showing tubes that do not need to be cleaned. Typically, these are rejected tubes, for example, rejected because of a metal part added beforehand.

In automatic mode, there is no need to display the optimal or enhanced path to the operator.

According to a third embodiment of the method, entirely automatic, a robot controlled by an algorithm can carry out the movements ($D_{ca}$) of the rod along the axes $x_1$ and $y_1$ by following the order defined by the optimal or enhanced path, as well as the movements $D_{ch}$ of the rod along the axis $z_1$. In automatic mode, there is no need to display the optimal or enhanced path to the operator, and therefore there is no longer a recovery need.

In practice, in automatic and semi-automatic modes, the robot positions the orthogonal comparison marker ($x_1$, $y_1$, $z_1$) in relation to the orthogonal reference marker ($x_0$, $y_0$, $z_0$), such that the hose is arranged opposite an orifice, marked and defined by the optimal or enhanced path defined by the second calculator Advantageously, the method according to the embodiments can further include, after each step G, an additional step of interacting with the operator or the second calculator with the enhanced image.

By interaction, it is meant in the sense of some embodiments, adding optional information which could help the operator or the second calculator, to form a new enhanced image serving as a reference during the carrying out of a new step G in view of cleaning a new orifice. This optional information can typically include any type of information that the operator responsible for the cleaning of the tubes wants to capitalize on, and which can be compiled in the cleaning report at the end of the operation: for example, the indication of the rejected holes, or holes of which the cleaning has not been able to be carried out correctly and which may require cleaning with another rod, or the history of the different cleaning steps carried out. The new enhanced, modified image can be stored in view of guaranteeing the traceability of the process by representing the initial status of the exchanger before each processing (steps E to I).

BRIEF DESCRIPTION OF THE FIGURES

Embodiments of the present invention will now be described in detail with reference to the accompanying drawings in which:

Other advantages and specificities of the present embodiments will emerge from the description which will follow, given as a non-exhaustive example and made in reference to the appended figures and to the corresponding examples:

FIG. 5B is a photograph taken by the camera in FIG. 5A of the support plate of the heat exchanger, whereas

DETAILED DESCRIPTION OF THE EMBODIMENTS

An example of an implementation of the method according to some embodiments is defined below using FIGS. 1A to 6B, whereon the same elements are identified by the same numerical references.

Figure 1A:
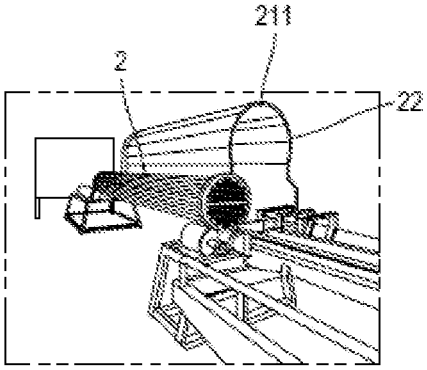
FIGS. 1A and 1B are photographs representing a first example of a heat exchanger to be cleaned including embedded, horizontal U-shaped tubes, leading to a vertical support plate.
Figure 1B:
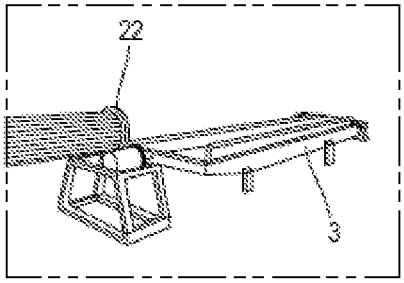
Figure 1C:
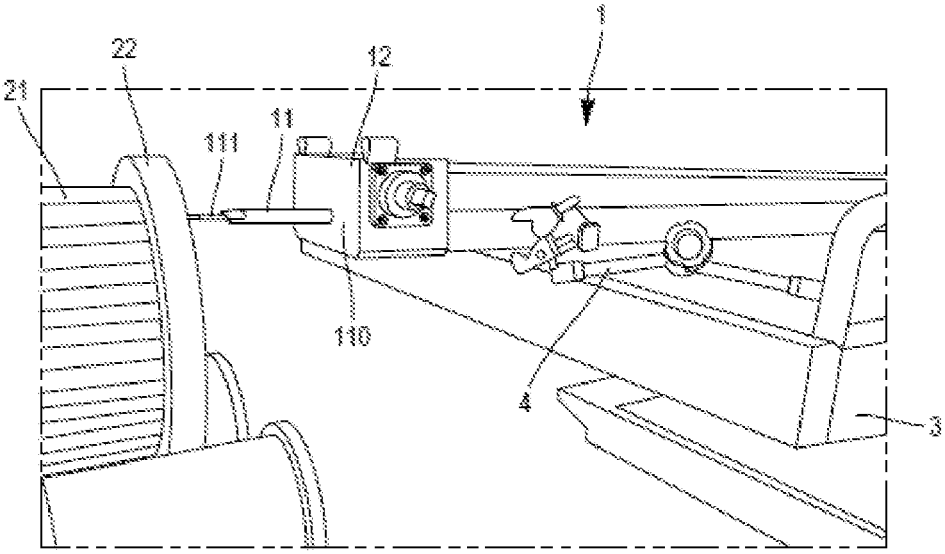
FIG. 1C is a photograph representing the heat exchanger in FIGS. 1A and 1B and a first example of a cleaning device such as implemented in the method according to some embodiments and including or consisting of a bundle cleaner equipped with a rigid cleaning rod.

The heat exchanger 2, represented in FIGS. 1A to 1C, is an exchanger including horizontal, U-shaped tubes 21, embedded and leading to a vertical support plate 22, at the level of their inlet 211 and outlet 212 orifices (more clearly visible in FIGS. 4A to 5C). Concerning more specifically the cleaning device 1 used for the implementation of the method according to some embodiments, it can include or can consist of a bundle cleaner 1 equipped with a rigid cleaning rod 11, of which one of the ends 111 is guided forward by a support 12 and intended to be inserted inside the tubes 21 of the exchanger 2 to clean them. The rod 11 is arranged horizontally on a cart 3 (visible in FIGS. 1B and 1C), which moves forward horizontally along a first axis, parallel to the symmetry axis of the rod 11, and along a second axis, perpendicular to the symmetry axis of the rod 11, and moves forward vertically along a third axis, perpendicular to the symmetry axis of the rod 11.

An orthogonal reference marker ($x_0$, $y_0$, $z_0$) is virtually connected directly and three-dimensionally to the support plate 22, such that the axes $x_0$ and $y_0$ thereof are contained in the plate 22 plane (or in a plane which itself is parallel) and the axis $z_0$ thereof is substantially horizontal. Likewise, an orthogonal comparison marker ($x_1$, $y_1$, $z_1$) is virtually connected directly and three-dimensionally to the cart 3, such that the axis $z_1$ thereof is parallel to the symmetry axis of the rod 11, as illustrated in FIGS. 2A, 2B, 4B, 5A and 5B. The position of the cart during a movement forward towards the support plate 22 is defined by the slope $z_1$ in relation to an initial position of the cart before movement, defined by the slope $z_1=0$.

Further to the rigid cleaning rod 11 arranged on the cart 3, the cleaning device according to some embodiments further includes the following components:

- an IR lighting to minimize the dependency of the quality of images under external conditions,
- a high-resolution camera 4, and
- a computerized processing station enduring the interface between the camera 4 and a medium for the display (screen or tablet not represented in the figures), for example, by wire or by radio waves (via a wi-fi or Bluetooth connection, in particular).

These components are chosen to function in the external environment.

Moreover, to avoid uncontrolled surrounding light, a dedicated lighting and a spectral filtering at the level of the camera (e.g. NIR @ 850 nm) (not visible to the naked eye, but visible by the camera), leading to the obtaining of a monochrome image. Advantageously, a monochrome, digital, 16-Megapixel (4096×4096) camera will be used, enabling to obtain a real image with a spatial resolution of less than 1 mm/pixel.

FIGS. 2A to 2C and 3A to 3C are graphic, schematic representations of a second example of a cleaning device and a second example of a heat exchanger, whereon the camera is remote in relation to the center of the support plate, by being arranged above the cleaning rod.

These graphic representations are indeed three-dimensional models produced by the CAD software, "SolidWorks", illustrating the distancing of the camera 4 in relation to the center of the heat exchanger 2.

Figure 2A:
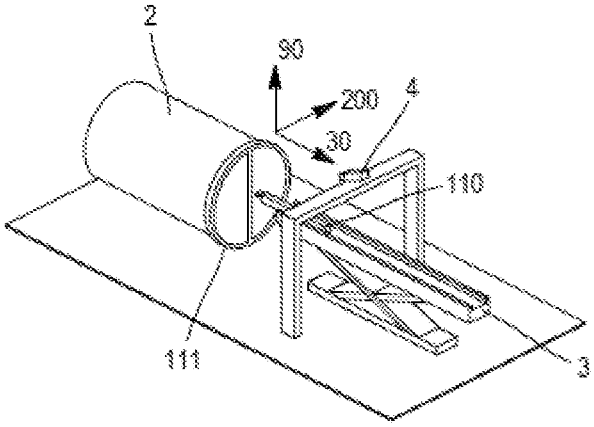
FIGS. 2A to 2C are schematic representations of a second example of a cleaning device and a second example of a heat exchanger, wherein the camera is arranged remotely in relation to the center of the support plate by being arranged above the cleaning rod.
Figure 2B:
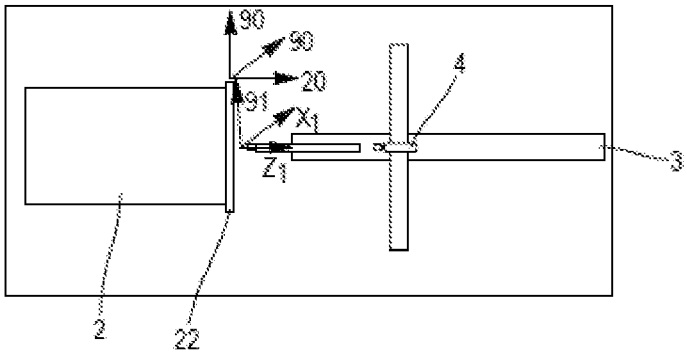
Figure 2C:
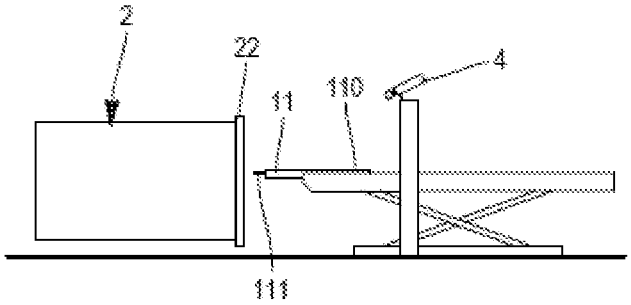
Figure 2D:
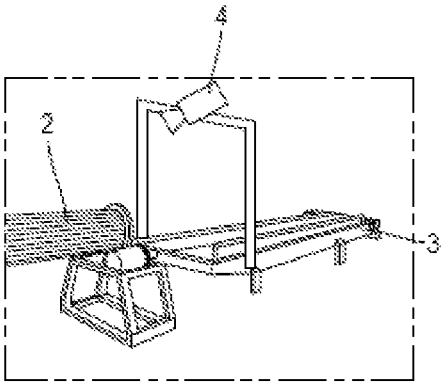
FIG. 2D is a photograph of the cleaning device and of the heat exchanger is FIGS. 1A to 1C, whereon the camera has been represented schematically above the cleaning rod, conform with the schematic arrangement in FIGS. 2A to 2C.
Figure 2E:
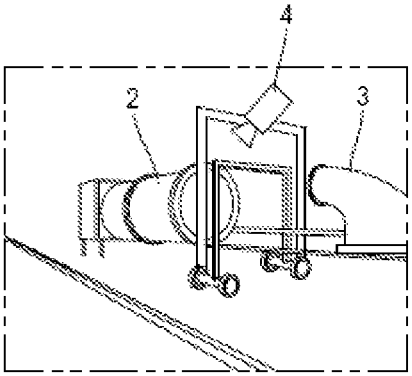
FIG. 2E is a photograph of a third example of a cleaning device and a third example of a heat exchanger, whereon the camera has been represented schematically above the cleaning rod, conform with the schematic arrangement in FIGS. 2A to 2C.

In particular, FIGS. 2A to 2C show an embodiment of the method according to some embodiments, according to which the camera 4 is remote in relation to the center of the support plate by being arranged above the cleaning rod 11. In such a configuration, the position of the cleaning camera 4 is fixed and protected (from the liquid projections and waste coming out of the tubes 21 during their cleaning). In addition, the camera 4 is centered on the support plate 22, which enables the perspective effects to be reduced, and the sensitivity to the sun to be reduced.

Figure 3A:
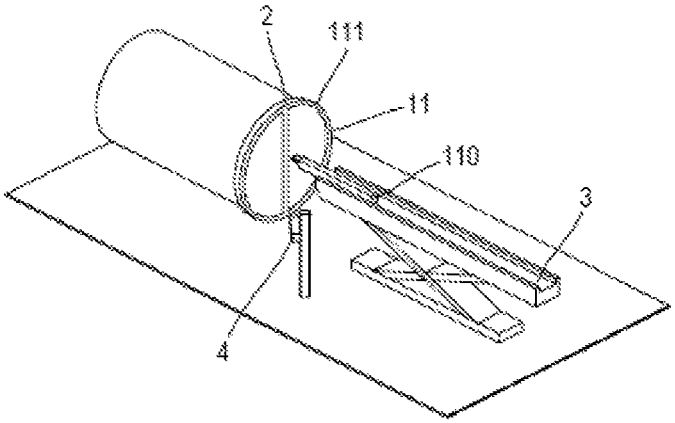
FIGS. 3A to 3C are schematic representations of the second cleaning device and the second heat exchanger, whereon the camera is arranged remote to the center of the support plate by being arranged laterally in relation to the support plate of the exchanger.
Figure 3B:
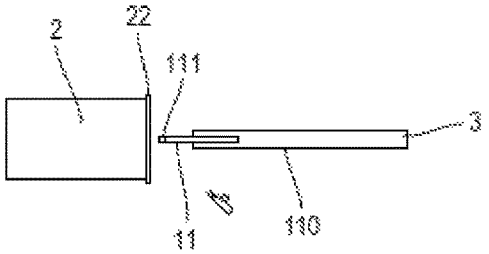
Figure 3C:
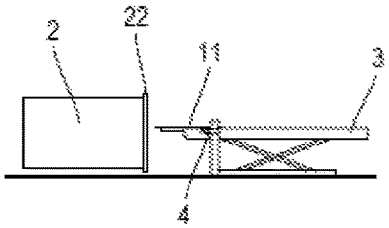
Figure 3D:
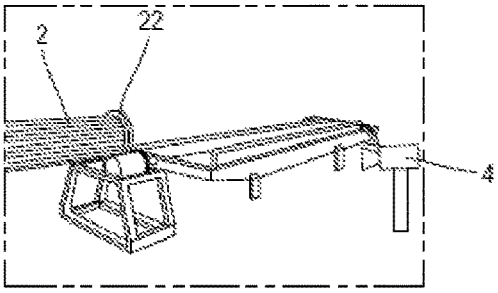
FIG. 3D is a photograph of the heat exchanger and cleaning device in FIGS. 1A to 1C, whereon the camera has been represented schematically laterally in relation to the center of the support plate of the exchanger, conform with the schematic arrangement in FIGS. 3A to 3C.
Figure 3E:
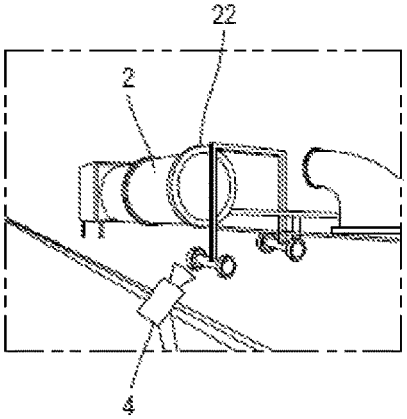
FIG. 3E is a photograph of the third example of a cleaning device and of the third example of a heat exchanger, whereon the camera has been represented schematically laterally in relation to the center of the support plate of the exchanger, conform with the schematic arrangement in FIGS. 3A to 3C.

FIGS. 3A to 3C show an embodiment of the method according to which the camera 4 is remote in relation to the center of the support plate by being arranged laterally in relation to the center of the support plate of the exchanger. In this case, it must or should be ensured, necessarily, that the angle formed by the plane of the camera 4 and the support plate 22 enables the camera 4 to film the whole of the plate 22, to avoid the disadvantage generated by a perspective that is too strong.

Figure 5A:
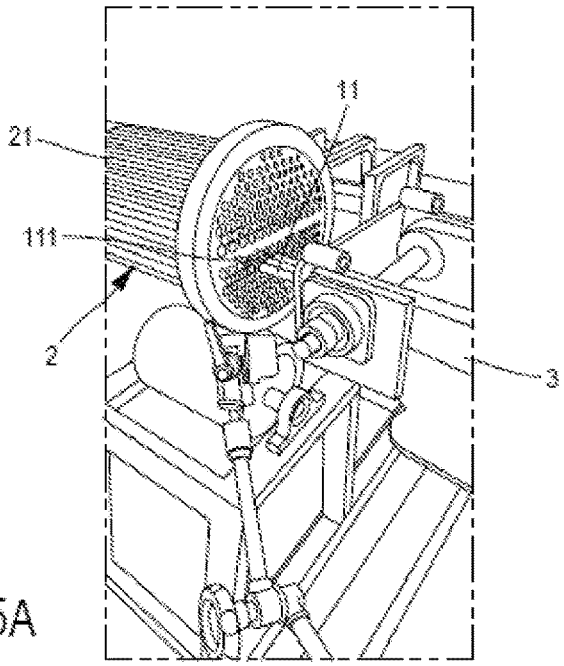
FIG. 5A is a photograph of the cleaning device and of the heat exchanger in FIGS. 1A to 1C and 3D, showing a camera (real and not schematic) positioned laterally at around 1 m from the center of the support plate, conform with the schematic arrangement in FIGS. 3A to 3C.
Figure 5B:
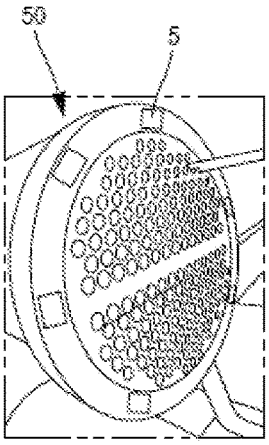

In the case of a lateral positioning of the camera 4 at around 1 m from the center of the support plate, as shown by the photograph in FIG. 5A, the real image 50 taken by this camera 4 shows a strong perspective effect, as shown by FIG. 5B. This effect can be corrected semi-automatically, by searching for the known characteristic points, for example, the points belonging to a circle and/or physical markers 5 positioned by the operator, as illustrated by FIG. 5C: a recovered image 51 is thus obtained.

Figure 5C:
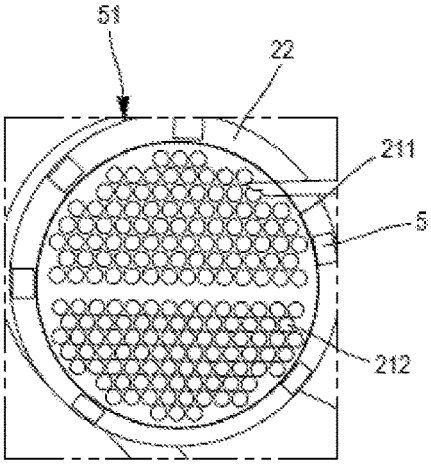
FIG. 5C shows this same photograph once recovered.

With a recovered display, such as shown by FIG. 5C, it is possible for an operator:

- to archive the image before, during and after the cleaning operation (traceability), and/or
- to annotate the image to indicate, for example, the zones to not process (blocked tubes) and or comments, and/or
- to assist with the positioning of the tubes (to be validated onsite by a test), and/or
- to monitor the progression of the tubes processed (for example, using a finger mark on the tubes while they are being processed, given that during cleaning, nothing happens to the camera, as the cover flap is closed).

From the high-resolution real images 50 thus obtained (between 0.5 and 1 mm/pixel), possibly recovered 51, and with the use of NIR lighting ensuring a certain independency in relation to the surroundings, a first calculator generates high-resolution monochrome images (enhanced images), that can be used for the automatic detection of the tubes and the stoppers.

Given the great disparity in heat exchangers, and without knowing the state of the surface before cleaning (for example, holes blocked with a rather clear material), the search algorithm of the tubes of the method according to some embodiments will be based on the fact that light does not enter or hardly enters the tubes, and therefore, the processing will search for local minima in the image.

To enhance this step of the method of the embodiments, it is advantageous to stick reflective dots 5 of a known size (at least 3) on a face of the exchanger (coplanar points), as illustrated in FIGS. 4A, 4B, 5B, 5C. These dots mainly have three functions, namely:

- defining a circular region 51 passing by three dots, and ensuring that searching for tubes is done inside this region,
- enabling the self-calibration system (intensity and spatial calibration), and
- facilitating perspective correction.

Figure 4A:
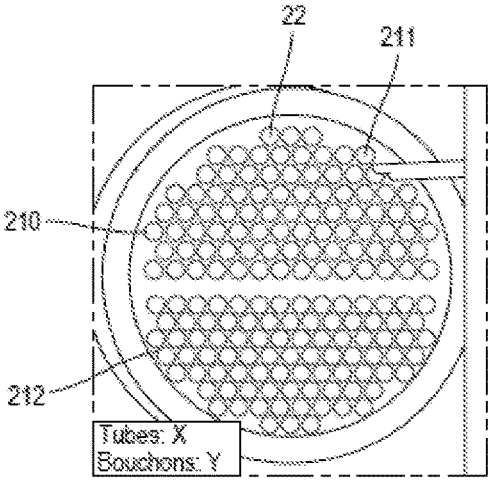
FIGS. 4A and 4B are enhanced images generated by a calculator, conform with the method according to some embodiments, showing a support plate with orifices equipped with one and two visual markings, respectively.
Figure 4B:
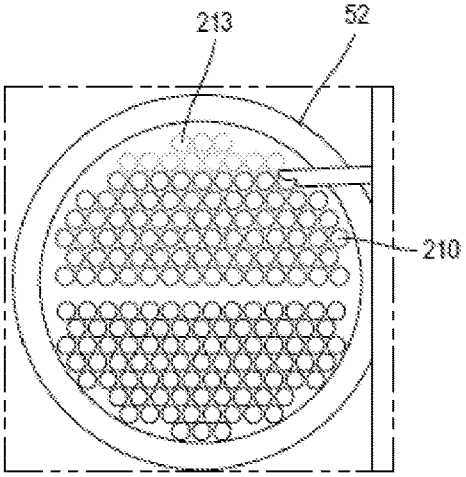

The enhanced images 52 generated by the first calculator include a first visual marking 210 of the tube orifices to be cleaned (marked orifices): in FIG. 4A, the contour of the tubes to be cleaned is highlighted by a line of a first color. The enhanced images 52 can also include, further to the first visual marking, a second visual marking 213 showing the tubes that do not need to be cleaned: in FIG. 4B, the contour of the tubes already cleaned is highlighted by a line of a different color.

To complete the remote visualization system previously defined, and to enable the automatic positioning of the bundle cleaner opposite the tube orifices 21, model objects can advantageously be used, of which the geometry is known, and of which the position and the orientation on the images taken with lighting of a known wavelength will be searched to be detected (preferably or possibly in the near-infrared at 850 nm) and a spectral filter on this wavelength at the level of the camera.

More specifically, as model objects, two luminous target objects 6, 7 can be advantageously used:

- a first target object 6 with four luminous target points 61, 62, 63, 64 is arranged connected to the support plate 22 such that the four target points 61, 62, 63, 64 thereof constitute the orthogonal reference marker ($x_0$, $y_0$, $z_0$), and
- a second target object 7 with four luminous target points 71, 72, 73, 74 is arranged connected to the mobile cart 3 such that the four target points 71, 72, 73, 74 thereof constitute the orthogonal comparison marker ($x_1$, $y_1$, $z_1$).

Figure 6A:
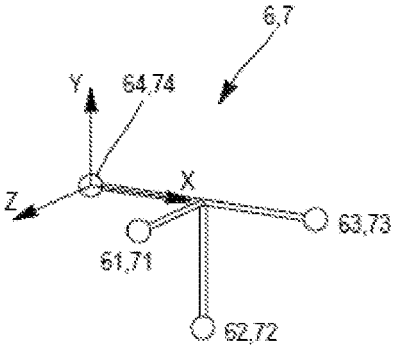
FIG. 6A schematically represents a target object with four target, luminous or reflecting points, intended to be arranged on the support plate or the rod, to serve as an orthogonal reference or comparison marker, respectively.

Such target objects are schematically represented in FIG. 6A.

These objects 6, 7 are comprised of or include target points 61, 62, 63, 64, or 71, 72, 73, 74, which are either passive (able to reflect light), or active (emitting light, for example, LEDs).

The target points 61, 62, 63, 64, 71, 72, 73, 74 reflect light coming from the same direction as the line of view of the camera 4. Only light reflected by the targets 6, 7 is captured by the camera 4.

Lighting of a known wavelength (for example, in the near-infrared at 850 nm) and a spectral filter on this wavelength at the level of the camera enabling to avoid the changes in light surroundings (for example, effects from the sun).

Figure 6B:
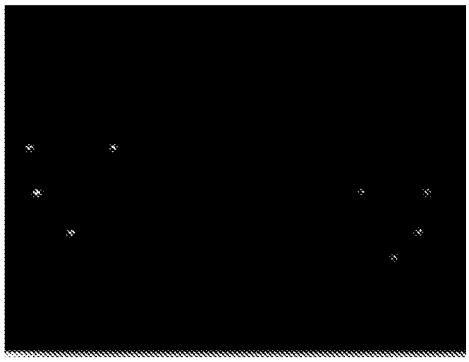
FIG. 6B is a simulation of what would be the image acquired of the heat exchanger and of the cleaning device in FIGS. 1A to 1C, each one equipped with the target object in FIG. 6A, with lighting in the near-infrared with a wavelength of 850 nm by using a spectral filter on this wavelength at the level of the camera.

An example of an image obtained by such a system is shown in FIG. 6B, showing two target points 6, 7 each containing 4 target points. It has a binary character, ensuring a very high processing robustness, whatever the type of objects visualized.

In practice, tracking and a 3D measurement of the position of the 2 target objects 6, 7 are made (FIG. 6B) using the camera 4. This gives, by different geometric transformations, the relative position of the cart in relation to the exchanger (or vice versa).

It is understood, in the framework of the present embodiments, that one same camera can be used for detecting tube orifices and for that of target objects. But, it is also possible to use two separate cameras.

By a calibration and construction mechanism of the initial model, it is then possible to construct a 3D model of the positions of the orifices 211, 212 of the tubes 21 of the exchanger 2, in order to assist the user or the robot in the positioning of the cleaning device in relation to the support plate 22 of the exchanger 2.

Positioning and Calibration

An advantage of using target objects 6, 7 is that there is no high limitation for the positioning of the rod 11 from the time when the two target objects 6, 7 are in the visual range of the camera.

The target objects 6, 7 can be protected from splashes by their positioning. These objects must or should simply be connected to the equipment (exchanger 2, or cart 3) whereon they are positioned.

The deployment of such a system is quick (less than 15 minutes). If the exchanger 2 moves during cleaning, the camera will track it, will give an alert and can even, during a reasonable movement (of a few centimeters), proceed with correcting the alignment, whether for the operator in manual or semi-automatic mode, or for the calculation device of the trajectory of the hoses in a completely automatic mode (notion of ongoing recalibration of the alignment, whatever the movement of an element in relation to another).

In practice, the calibration phase consists of or includes positioning the bundle cleaners along the 4 cardinal points in relation to the exchanger 2 and capturing a measurement at each position. By then entering the geometry of the different tubes 21, the system is self-calibrated, and is capable of knowing the position that the model must or should be in to be opposite the tubes 21. This geometry can come from information entered by the operator using simple tools, by using an image, for example, and/or the automatic detection of tubes 21. It is thus possible to project the current position of the bundle cleaners 1 on a mesh of virtual or real tubes (image coming from the other system).

The invention claimed is:

1. A method for guiding a high-pressure cleaning devise for cleaning an inside of tubes of a heat exchanger with tube bundles that are substantially rectilinear, and which is not connected to the cleaning device, the tubes being embedded in a support plate substantially perpendicular to the tubes, at the level of the inlet and outlet orifices, and the cleaning device including at least one rigid cleaning rod, of which one of the ends is guided forward by a support and is intended to be inserted inside the tubes to clean the tubes, the rod being arranged, substantially horizontal, on a cart moving forward horizontally along a first axis, parallel to the symmetry axis of the rod and along a second axis, perpendicular to the symmetry axis of the rod, and moving forward vertically along a third axis, perpendicular to the symmetry axis of the rod;

an orthogonal reference marker ($x_0$, $y_0$, $z_0$), direct and three-dimensional, being connected to the support plate, such that the axes $x_0$ and $y_0$ thereof are contained in a vertical plane, substantially parallel to the plate and the axis $z_0$ thereof is substantially horizontal;

an orthogonal comparison marker ($x_1$, $y_1$, $z_1$), direct and three-dimensional, being connected to the cart, such that the axis $z_1$ thereof is parallel to the symmetry axis of the rod, the position of the cart during a movement forward towards the support plate being defined by the slope $z_1$ in relation to an initial position of the cart before movement defined by the slope $z_1$=0;

the method comprising:

A. taking a real image, by a camera, of the arrangement of the inlet or outlet orifices at the level of the support plate, the camera being remote in relation to the center of the support plate;

B. sending the real image to a first calculator which identifies the shape and the position of the orifices according to the marker as well as their possible obstruction;

C. calibrating the comparison marker ($x_1$, $y_1$, $z_1$) in relation to the reference marker ($x_0$, $y_0$, $z_0$) to enable the obtaining in real time of the position of the hose in relation to the orifices;

D. from the real image, calculating, by a calculator, an optimal path for positioning the rod enabling the cleaning of all the tubes, of which the orifices have the first visual marking, according to their arrangement in the marker ($x_0$, $y_0$ $z_0$), of the calibration between the reference ($x_0$, $y_0$ $z_0$) and comparison ($x_1$, $y_1$ $z_1$) markers and of the number of cleaning rods that the cleaning device includes, the optimal path defining an order of succession of movements ($D_{ca}$) of the rod along the axes $x_1$ and $y_1$ between which at least two movements ($D_{ch}$) of the cart along the axis $z_1$ take place to clean the tubes represented by their orifice including the first marking on the enhanced image;

E. displaying the optimal path proposed and the enhanced image on a display screen;

F. carrying out, by an operator and/or a robot controlled by an algorithm, of a cleaning step $E_{net}$including the sub-steps:

a. F1) the movements ($D_{ca}$) of the rod along the axes $x_1$ and $y_1$, such that the rod is arranged opposite a tube to be cleaned represented by the orifice thereof, including the first marking on the enhanced image;

b. F2) a first movement $D_{ch}$of the rod along the axis $z_1$, through the first orifice to clean the tube;

c. F3) once the tube is cleaned, a second movement $D_{ch}$ along the axis $z_1$ of the rod enabling the withdrawal outside of the orifice; then G. repeating steps D to F until all cleaning steps $E_{net}$ provided by the optimal path are carried out.

2. The method according to claim 1, wherein an operator controls all the movements ($D_{ca}$) and ($D_{ch}$) of the rod during the cleaning step $E_{net}$, by following the order of succession of the movements ($D_{ca}$) of the rod defined by the optimal path.

3. The method according to claim 1, wherein:

a robot controlled by an algorithm carries out the movements ($D_{ca}$) of the rod along the axes $x_1$ and $y_1$ by following the order defined by the optimal path, whereas an operator carries out the movements $D_{ch}$ of the rod along the axis $z_1$), the robot controlled by an algorithm waits for the operator to carry out the movements $D_{ch}$ before starting the movements $D_{ca}$ of the following cleaning step $E_{net+1}$.

4. The method according to claim 2, further comprising, between steps B and C:

B') generating by the first calculator, from the real image, an enhanced image including a first visual marking of the orifices of the tubes to be cleaned; and B") sending of the enhanced image to a second calculator, which then calculates, during step D, the optimal path of positioning, from the real image.

5. The method according to claim 4, wherein the enhanced image generated in step B') comprises, further to the first visual marking of the orifices of the tubes to be cleaned, a second visual marking of the tubes not needing to be cleaned.

6. The method according to claim 4, wherein the real image is correct so as to give a recovered image before being sent to the second calculator to generate an enhanced image.

7. The method according to claim 4, further comprising, after each step G, an additional step of interaction of the operator or of the second calculator with the enhanced image.

8. The method according to claim 1, wherein a robot controlled by an algorithm carries out the movements ($D_{ca}$) of the rod along the axes $x_1$ and $y_1$ by following the order defined by the optimal path, as well as the movements $D_{ch}$ of the rod along the axis $z_1$.

9. The method according to claim 1, wherein the real image is taken by an infrared or near-infrared camera equipped with an optical filter, with infrared or near-infrared lighting.

10. The method according to claim 1, wherein the following are used:

a first target object including four luminous target points emitting or being able to reflect light, the first target object being arranged on the support plate such that the four target points thereof constitute the orthogonal reference marker ($x_0$, $y_0$, $z_0$), and a second target object including four luminous target points emitting or being able to reflect light, the second target object being arranged on the mobile cart such that the four target points thereof constitute the orthogonal comparison marker ($x_1$, $y_1$, $z_1$).

11. The method according to claim 3, further comprising, between steps B and C:

B') generating by the first calculator, from the real image, an enhanced image including a first visual marking of the orifices of the tubes to be cleaned; and B") sending of the enhanced image to a second calculator, which then calculates, during step D, the optimal path of positioning, from the real image.

12. The method according to claim 5, wherein the real image is correct so as to give a recovered image before being sent to the second calculator to generate an enhanced image.

13. The method according to claim 5, further comprising, after each step G, an additional step of interaction of the operator or of the second calculator with the enhanced image.

14. The method according to claim 6, further comprising, after each step G, an additional step of interaction of the operator or of the second calculator with the enhanced image.

15. The method according to claim 2, wherein the real image is taken by an infrared or near-infrared camera equipped with an optical filter, with infrared or near-infrared lighting.

16. The method according to claim 3, wherein the real image is taken by an infrared or near-infrared camera equipped with an optical filter, with infrared or near-infrared lighting.

17. The method according to claim 4, wherein the real image is taken by an infrared or near-infrared camera equipped with an optical filter, with infrared or near-infrared lighting.

18. The method according to claim 5, wherein the real image is taken by an infrared or near-infrared camera equipped with an optical filter, with infrared or near-infrared lighting.

19. The method according to claim 6, wherein the real image is taken by an infrared or near-infrared camera equipped with an optical filter, with infrared or near-infrared lighting.

20. The method according to claim 7, wherein the real image is taken by an infrared or near-infrared camera equipped with an optical filter, with infrared or near-infrared lighting.

* * * * *